US012502704B2

(12) United States Patent
Nogiwa et al.

(10) Patent No.: US 12,502,704 B2
(45) Date of Patent: Dec. 23, 2025

(54) FORMING DEVICE AND METAL PIPE

(71) Applicant: SUMITOMO HEAVY INDUSTRIES, LTD., Tokyo (JP)

(72) Inventors: Kimihiro Nogiwa, Niihama (JP); Akihiro Ide, Niihama (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 274 days.

(21) Appl. No.: 18/149,663

(22) Filed: Jan. 3, 2023

(65) Prior Publication Data

US 2023/0148390 A1 May 11, 2023

Related U.S. Application Data

(63) Continuation of application No. PCT/JP2021/028982, filed on Aug. 4, 2021.

(30) Foreign Application Priority Data

Aug. 11, 2020 (JP) ..... 2020-135822

(51) Int. Cl.
*B21D 26/033* (2011.01)

(52) U.S. Cl.
CPC ..... *B21D 26/033* (2013.01)

(58) Field of Classification Search
CPC ..... B21D 26/02; B21D 26/033; B21D 26/047
See application file for complete search history.

(56) References Cited

U.S. PATENT DOCUMENTS

| | | | | |
|---|---|---|---|---|
| 4,827,747 | A * | 5/1989 | Okada | B21D 26/047 72/370.19 |
| 6,637,246 | B1 * | 10/2003 | Shimanovski | B21D 26/033 72/62 |
| 10,773,292 | B2 | 9/2020 | Saika et al. | |
| 2003/0151273 | A1 | 8/2003 | Sakamoto et al. | |
| 2017/0120317 | A1 | 5/2017 | Ishizuka et al. | |
| 2018/0078988 | A1 | 3/2018 | Ishizuka et al. | |
| 2018/0161843 | A1 | 6/2018 | Saika et al. | |

FOREIGN PATENT DOCUMENTS

| | | |
|---|---|---|
| EP | 1 293 415 B1 | 1/2012 |
| EP | 3 305 430 A1 | 4/2018 |
| JP | 3 205105 B2 | 9/2001 |
| JP | 3 687838 B2 | 8/2005 |

(Continued)

OTHER PUBLICATIONS

PCT International Search Report for PCT/JP2021/028982 mailed on Oct. 19, 2021 by Japanese Patent Office.

(Continued)

*Primary Examiner* — Teresa M Ekiert
(74) *Attorney, Agent, or Firm* — WTA IP Law P.C.

(57) ABSTRACT

A forming device is a forming device that forms a metal pipe with a flange and includes a forming tool for forming the metal pipe, in which the forming tool includes a first die and a second die that face each other in a first direction in a cross-sectional view, and a third die for regulating a planned flange portion of a metal pipe material, and the third die continues to correct misalignment of the planned flange portion until the first die and the second die are clamped.

11 Claims, 9 Drawing Sheets

(56) References Cited

FOREIGN PATENT DOCUMENTS

| | | | |
|---|---|---|---|
| JP | 2006175521 | | 7/2006 |
| JP | 2009-220141 | A | 10/2009 |
| JP | 2016 019996 | A | 2/2016 |
| JP | 2019072741 | | 5/2019 |
| WO | WO 2017/034025 | | 3/2017 |

OTHER PUBLICATIONS

European Search Report of EP Application No. 21855922.7 Mailed on Feb. 19, 2024.

* cited by examiner

FORMING DEVICE AND METAL PIPE

CROSS-REFERENCE TO RELATED APPLICATIONS

This is a bypass continuation of International PCT Application No. PCT/JP2021/028982, filed on Aug. 4, 2021, which claims priority to Japanese Patent Application No. 2020-135822, filed on Aug. 11, 2020, which are incorporated by reference herein in their entirety.

BACKGROUND

Technical Field

Certain embodiments of the present invention relate to a forming device and a metal pipe.

Description of Related Art

In the related art, a forming device used for forming a metal pipe is known. For example, the related art described below discloses a forming device that includes a forming tool including a lower die and an upper die paired with each other, and a fluid supply unit for supplying a fluid into a metal pipe material held between the forming dies.

SUMMARY

A forming device according to an aspect of the present invention is a forming device that forms a metal pipe with a flange and includes a forming tool for forming the metal pipe, in which the forming tool includes a first die and a second die that face each other in a first direction in a cross-sectional view, and a third die for regulating a planned flange portion of a metal pipe material, and the third die continues to correct misalignment of the planned flange portion until the first die and the second die are clamped.

A metal pipe according to an aspect of the present invention includes a hollow pipe portion, and a pair of flange portions protruding from the pipe portion to both sides in a width direction, in which sizes of the pair of flange portions in the width direction are predetermined sizes different from each other.

A forming device according to an aspect of the present invention is a forming device that forms a metal pipe with a flange and includes a forming tool for forming the metal pipe, in which the forming tool includes a first die and a second die facing each other in a first direction in a cross-sectional view, and a third die disposed on at least one side of a metal pipe material in a second direction intersecting the first direction, and the third die moves away from the metal pipe material as the first die and the second die approach each other.

DETAILED DESCRIPTION

Figure 1:
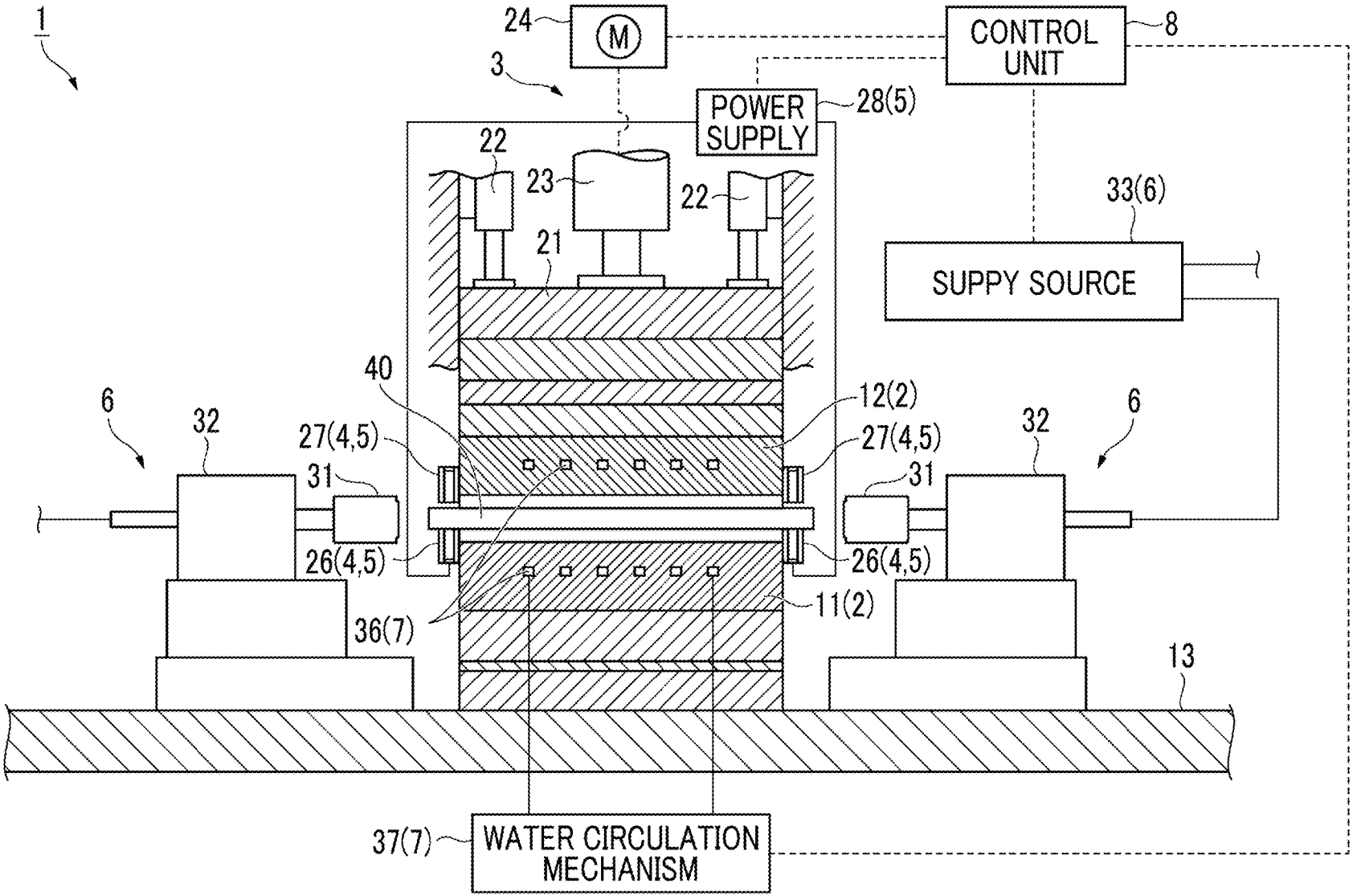
FIG. 1 is a schematic view of a forming device according to an embodiment of the present invention.

In the forming device such as the related art described above, there is a case where the metal pipe having a flange is formed by crushing both sides of the metal pipe material in a width direction with the upper die and the lower die. However, such a forming device has a problem in that it is difficult to forma flange portion to a desired size because when the flange portion is expanding in the width direction, the expansion cannot be regulated.

It is desirable to provide a forming device capable of reducing variation in size of a flange portion, and a metal pipe in which the variation in size of the flange portion is reduced.

In the forming device, the forming tool includes the first die and the second die that face each other in the first direction in a cross-sectional view. In addition, the forming tool includes the third die for regulating the planned flange portion of the metal pipe. The third die continues to correct the misalignment of the planned flange portion until the first die and the second die are clamped. Therefore, even in a state in which a die closing operation of the first die and the second die progresses so that crushing of the planned flange portion progresses, the third die can continue to correct the misalignment of the planned flange portion. As described above, it is possible to reduce the variation in size of the flange portion after completion.

The third die may be disposed on at least one side of the metal pipe material in a second direction intersecting the first direction, and the third die may move away from the metal pipe material as the first die and the second die approach each other. The third die can restrict the flange portion of the metal pipe material, which is crushed by the first die and the second die, from expanding excessively in the second direction. Here, the third die moves away from the metal pipe material as the first die and the second die approach each other. Therefore, even in a state in which a die closing operation of the first die and the second die progresses so that crushing of the flange portion progresses, the third die can continue to regulate the flange portion. As described above, it is possible to reduce the variation in size of the flange portion.

The third die may move away from the metal pipe material as the first die and the second die approach each other by a tapered structure formed with at least one of the first die and the second die. In this case, the third die can be kept away from the metal pipe material with a simple structure.

The forming tool may form the metal pipe which is curved when viewed from the first direction. In this case, the size of the flange portion tends to vary between an inner peripheral side and an outer peripheral side of the curve, but the variation can be reduced by adopting the configuration of the present invention.

The metal pipe may include flange portions on both sides in a second direction intersecting the first direction, and the forming tool may include a pair of the third dies disposed on both sides of the metal pipe material in the second direction.

In this case, it is possible to reduce the variation in size of the flange portions on both sides of the metal pipe.

Each of the pair of the third dies may be disposed such that the flange portions on both sides have the same size in the second direction. In this case, the flange portions on both sides of the metal pipe can have the same size.

Each of the pair of the third dies may be disposed such that sizes of the flange portions on both sides in the second direction are predetermined sizes different from each other. In this case, each of the flange portions on both sides of the metal pipe can have a desired size.

The forming device may further include a fluid supply unit that supplies a fluid to the metal pipe material that is heated. The size of the flange portion of the heated metal pipe material tends to vary due to variation in temperature or the like, but the variation can be reduced by adopting the configuration of the present invention.

The forming device may further include an elastic mechanism that applies an elastic force to the third die toward the metal pipe material in a second direction intersecting the first direction. In this case, when the first die and the second die are opened, the third die can be returned to its original position without providing an expensive actuator or the like.

In the metal pipe, the sizes of the pair of flange portions in the width direction are predetermined sizes different from each other. In this case, since processing is performed such that each flange portion has a predetermined size during forming, it is possible to reduce the variation in size of the flange portion.

In the forming device, the forming tool includes the first die and the second die that face each other in the first direction in a cross-sectional view. In addition, the forming tool includes the third die disposed on at least one side of the metal pipe material in a second direction intersecting the first direction. The third die can restrict the flange portion of the metal pipe material, which is crushed by the first die and the second die, from expanding excessively in the second direction. Here, the third die moves away from the metal pipe material as the first die and the second die approach each other. Therefore, even in a state in which a die closing operation of the first die and the second die progresses so that crushing of the flange portion progresses, the third die can continue to regulate the flange portion. As described above, it is possible to reduce the variation in size of the flange portion.

Hereinafter, preferred embodiments of the present invention will be described with reference to the drawings. In addition, in the respective drawings, the same portions or corresponding portions are designated by the same reference signs, and duplicated descriptions will be omitted.

FIG. 1 is a schematic view of a forming device 1 according to the present embodiment. As shown in FIG. 1, the forming device 1 is an apparatus that forms a metal pipe having a hollow shape by blow forming. In the present embodiment, the forming device 1 is installed on a horizontal plane. The forming device 1 includes a forming tool 2 (forming die), a drive mechanism 3, a holding unit 4, a heating unit 5, a fluid supply unit 6, a cooling unit 7, and a control unit 8. In addition, in the present specification, the metal pipe refers to a hollow article after completion of forming in the forming device 1, and a metal pipe material 40 refers to a hollow article before completion of forming in the forming device 1. The metal pipe material 40 is a steel type pipe material that can be hardened. In addition, in the horizontal direction, a direction in which the metal pipe material 40 extends during forming is sometimes referred to as a "longitudinal direction", and a direction orthogonal to the longitudinal direction is sometimes referred to as a "width direction (second direction)".

The forming tool 2 is a die for forming the metal pipe material 40 into the metal pipe and includes a lower die 11 (first die) and an upper die 12 (second die) facing each other in a vertical direction (first direction). In addition, the forming tool 2 includes a pair of lateral dies 14 and 15 (third dies) facing each other in the width direction (refer to FIGS. 3A and 3B). Detailed shapes and the like of the dies 11, 12, 14, and 15 will be described later. The lower die 11 and the upper die 12 are made of steel blocks. The lower die 11 is fixed to a base stage 13 via a die holder or the like. The upper die 12 is fixed to a slide of the drive mechanism 3 via a die holder or the like.

The drive mechanism 3 is a mechanism that moves at least one of the lower die 11 and the upper die 12. In FIG. 1, the drive mechanism 3 has a configuration in which only the upper die 12 is moved. The drive mechanism 3 includes a slide 21 that moves the upper die 12 such that the lower die 11 and the upper die 12 are joined together, and a pull-back cylinder 22 serving as an actuator that generates a force for pulling the slide 21 upward, a main cylinder 23 serving as a drive source that downward-pressurizes the slide 21, and a drive source 24 that applies a driving force to the main cylinder 23.

The holding unit 4 is a mechanism that holds the metal pipe material 40 disposed between the lower die 11 and the upper die 12. The holding unit 4 includes a lower electrode 26 and an upper electrode 27 that hold the metal pipe material 40 on one end side in the longitudinal direction of the forming tool 2, and a lower electrode 26 and an upper electrode 27 that holds the metal pipe material 40 on the other end side in the longitudinal direction of the forming tool 2. The lower electrodes 26 and the upper electrodes 27 on both sides in the longitudinal direction hold the metal pipe material 40 by sandwiching vicinities of the end portions of the metal pipe material 40 from the vertical direction. In addition, groove portions having a shape corresponding to an outer peripheral surface of the metal pipe material 40 are formed on an upper surface of the lower electrode 26 and a lower surface of the upper electrode 27. The lower electrode 26 and the upper electrode 27 are provided with drive mechanisms (not shown) and are movable independently in the vertical direction.

The heating unit 5 heats the metal pipe material 40. The heating unit 5 is a mechanism that heats the metal pipe material 40 by energizing the metal pipe material 40. The heating unit 5 heats the metal pipe material 40 in a state in which the metal pipe material 40 is spaced apart from the lower die 11 and the upper die 12 between the lower die 11 and the upper die 12. The heating unit 5 includes the lower electrodes 26 and the upper electrodes 27 on both sides in the longitudinal direction as described above, and a power supply 28 that causes an electric current to flow to the metal pipe material through the electrodes 26 and 27. In addition, the heating unit 5 may be disposed in a preceding process of the forming device 1 and may perform heating externally.

The fluid supply unit 6 is a mechanism that supplies a high-pressure fluid into the metal pipe material 40 held between the lower die 11 and the upper die 12. The fluid supply unit 6 supplies the high-pressure fluid into the metal pipe material 40 that has been brought into a high-temperature state by being heated by the heating unit 5 and expands the metal pipe material 40. The fluid supply unit 6 is provided on both end sides of the forming tool 2 in the longitudinal direction. The fluid supply unit 6 includes a nozzle 31 that supplies a fluid from an opening portion of an end portion of the metal pipe material 40 to the inside of the metal pipe material 40, a drive mechanism 32 that moves the nozzle 31 forward and backward with respect to the opening portion of the metal pipe material 40, and a supply source 33 that supplies the high-pressure fluid into the metal pipe material 40 via the nozzle 31. The drive mechanism 32 brings the nozzle 31 into close contact with the end portion of the metal pipe material 40 in a state in which a sealing property is secured at the time of supply and exhaust of the fluid (refer to FIG. 2) and at other times, separates the nozzle 31 from the end portion of the metal pipe material 40. In addition, the fluid supply unit 6 may supply a gas such as high-pressure air or an inert gas as the fluid. Additionally, the fluid supply unit 6 may include the heating unit 5 together with the holding unit 4 having a mechanism that moves the metal pipe material 40 in the vertical direction as the same device.

Figure 2:
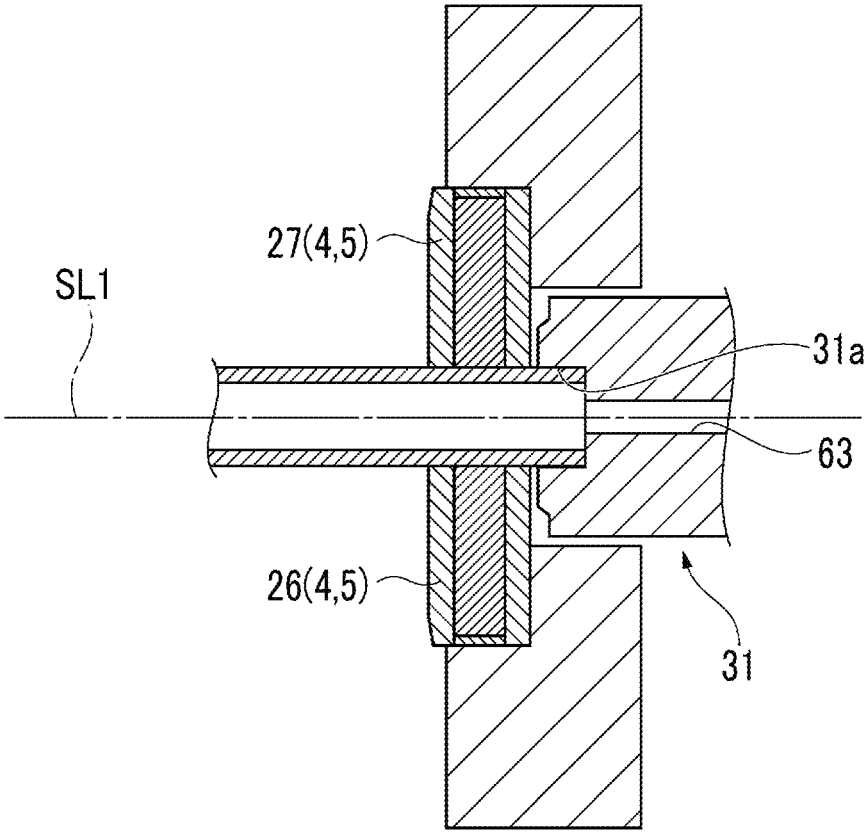
FIG. 2 is a cross-sectional view showing a state when a nozzle has sealed a metal pipe material.

FIG. 2 is a cross-sectional view showing a state in which the nozzle 31 seals the metal pipe material 40. As shown in FIG. 2, the nozzle 31 is a cylindrical member into which the end portion of the metal pipe material 40 can be inserted. The nozzle 31 is supported by the drive mechanism 32 such that a center line of the nozzle 31 coincides with a reference line SL1. An inner diameter of a supply port 31*a* at an end portion of the nozzle 31 on the side of the metal pipe material 40 substantially coincides with an outer diameter of the metal pipe material 40 after expansion forming. In this state, the nozzle 31 supplies the high-pressure fluid to the metal pipe material 40 from an internal flow path 36. Examples of the high-pressure fluid include a gas and the like.

Returning to FIG. 1, the cooling unit 7 is a mechanism for cooling the forming tool 2. By cooling the forming tool 2, the cooling unit 7 can rapidly cool the metal pipe material 40 when the expanded metal pipe material 40 has come into contact with a forming surface of the forming tool 2. The cooling unit 7 includes the flow path 36 formed inside the lower die 11 and the upper die 12, and a water circulation mechanism 37 that supplies cooling water to the flow path 36 and circulates the cooling water.

The control unit 8 is a device that controls the entire forming device 1. The control unit 8 controls the drive mechanism 3, the holding unit 4, the heating unit 5, the fluid supply unit 6, and the cooling unit 7. The control unit 8 repeatedly performs an operation of forming the metal pipe material 40 with the forming tool 2.

Specifically, the control unit 8 controls, for example, a transport timing from a transport device such as a robot arm to dispose the metal pipe material 40 between the lower die 11 and the upper die 12 in an open state. Alternatively, the control unit 8 may wait for a worker to manually dispose the metal pipe material 40 between the lower die 11 and the upper die 12. Additionally, the control unit 8 controls an actuator of the holding unit 4 and the like such that the metal pipe material 40 is supported by the lower electrodes 26 on both sides in the longitudinal direction, and then the upper electrodes 27 are lowered to sandwich the metal pipe material 40. Additionally, the control unit 8 controls the heating unit 5 to energize and heat the metal pipe material 40. Accordingly, an axial electric current flows through the metal pipe material 40, and an electric resistance of the metal pipe material 40 itself causes the metal pipe material 40 itself to generate heat due to Joule heat.

The control unit 8 controls the drive mechanism 3 to lower the upper die 12 and bring the upper die 12 close to the lower die 11 to close the forming tool 2. On the other hand, the control unit 8 controls the fluid supply unit 6 to seal the opening portions of both ends of the metal pipe material 40 with the nozzle 31 and supply the fluid. Accordingly, the metal pipe material 40 softened by heating expands and comes into contact with the forming surface of the forming tool 2. Then, the metal pipe material 40 is formed so as to follow a shape of the forming surface of the forming tool 2. When the metal pipe material 40 comes into contact with the forming surface, hardening of the metal pipe material 40 is performed by being quenched with the forming tool 2 cooled by the cooling unit 7.

Figure 9A:
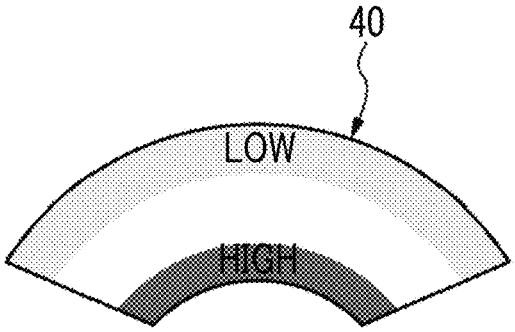
FIGS. 9A to 9C are schematic views showing states of bending of the metal pipe material and a metal pipe.

A detailed configuration of the forming tool 2 of the forming device 1 will be described with reference to FIGS. 3A and 3B and FIGS. 4A and 4B. First, a metal pipe 41 formed by the forming tool 2 will be described with reference to FIG. 4B. The metal pipe 41 includes a hollow pipe portion 41*a* and flange portions 41*b* and 41*c* protruding to both sides in the width direction. The pipe portion 41*a* has a rectangular tubular shape. However, a shape of the pipe portion 41*a* is not particularly limited and may be any shape depending on applications. The flange portions 41*b* and 41*c* are formed by crushing both end portions of the metal pipe material 40 in the width direction with the dies 11 and 12. In the metal pipe material 40, locations that are planned to become the flange portions 41*b* and 41*c* after completion are referred to as planned flange portions 40*b* and 40*c* (FIG. 4A). Also in the following description, unless otherwise specified, a protrusion portion in the metal pipe 41 after completion of forming is referred to as a "flange portion". Further, in the metal pipe material 40 in a state before the completion of forming, a location planned to become the flange portion after the completion is referred to as a "planned flange portion". A shape of the "planned flange portion" changes depending on the degree of progress of forming. Further, as shown in FIG. 9A, the metal pipe 41 is curved so as to protrude to one side in the width direction when viewed from the vertical direction. In an example shown in FIG. 9A, the flange portion 41*b* is disposed on an inner peripheral side and the flange portion 41*c* is disposed on an outer peripheral side.

Figure 3A:
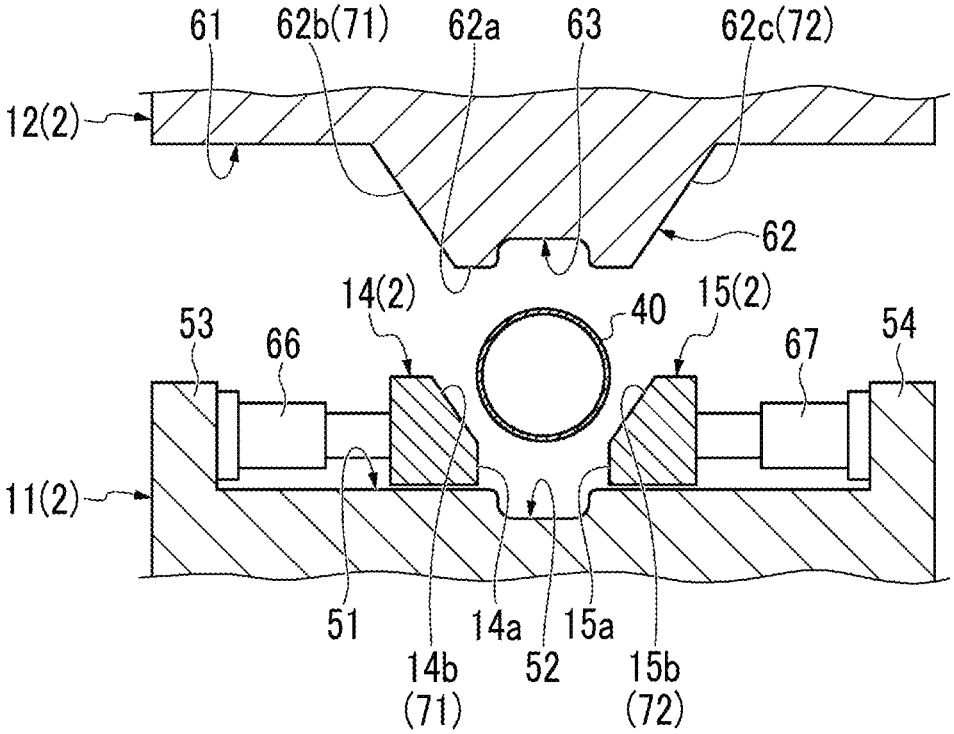
FIGS. 3A and 3B are cross-sectional views showing a forming process using a forming tool.
Figure 4A:
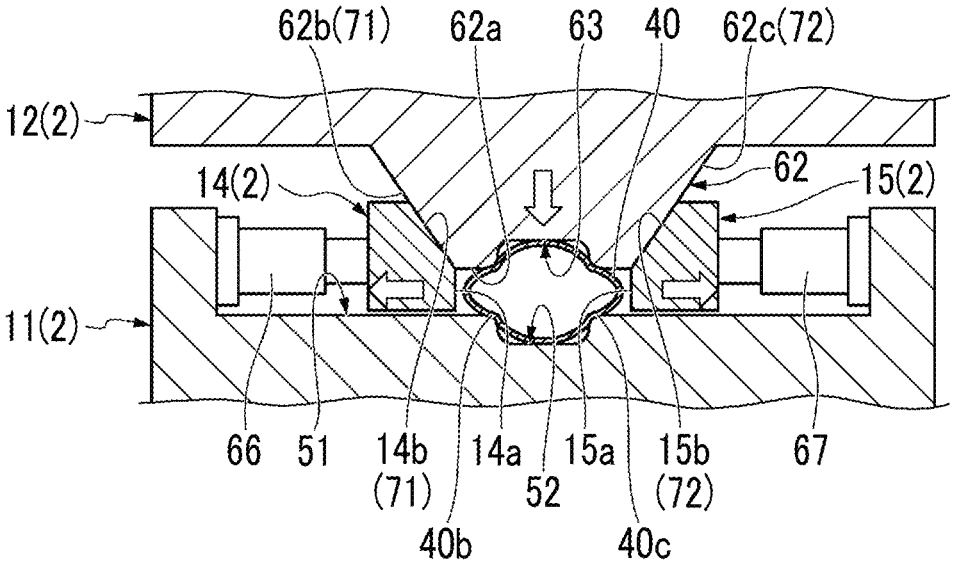
FIGS. 4A and 4B are cross-sectional views showing a forming process using the forming tool.

As shown in FIG. 3A, the lower die 11 includes a planar portion 51 expanding in the width direction, a recessed portion 52 formed at a center position in the width direction of the planar portion 51, and support portions 53 and 54 formed at both outer end portions in the width direction. The recessed portion 52 is a portion that forms a lower portion of the pipe portion 41*a* of the metal pipe 41 (refer to FIG. 4B). In the planar portion 51, both sides of the recessed portion 52 in the width direction are configured as forming surfaces for forming the flange portions 41*b* and 41*c* (refer to FIG. 4B). The support portions 53 and 54 are portions that protrude upward from the planar portion 51. The support portion 53 is a portion that supports the lateral die 14, and the support portion 54 is a portion that supports the lateral die 15.

The upper die 12 includes a planar portion 61 expanding in the width direction and a forming body portion 62 protruding downward at a center position of the planar portion 61 in the width direction. The forming body portion 62 has a substantially trapezoidal cross-sectional shape that narrows downward. The forming body portion 62 includes a recessed portion 63 on a lower surface 62*a*. The recessed portion 63 is a portion that forms an upper portion of the pipe portion 41*a* of the metal pipe 41 (refer to FIG. 4B). The lower surface 62*a* of the forming body portion 62 is configured as forming surfaces for forming the flange portions 41*b* and 41*c* on both sides of the recessed portion 63 in the width direction (refer to FIG. 4B). The forming body portion 62 includes tapered surfaces 62*b* and 62*c* that expand outward in the width direction from the lower surface 62*a* toward the planar portion 61 located above.

The lateral die 14 is disposed on one side of the metal pipe material 40 in the width direction. The lateral die 15 is disposed on the other side of the metal pipe material 40 in the width direction. The dies 14 and 15 are dies that, when the planned flange portions 40*b* and 40*c* of the metal pipe material 40 are expanding outward in the width direction, regulate the expansion of the planned flange portions 40*b* and 40*c*. The dies 14 and 15 include regulation surfaces 14*a* and 15*a* that regulate the expansion of the planned flange portions 40*b* and 40*c* on an inner side in the width direction. On an upper side of the regulation surfaces 14*a* and 15*a*, tapered surfaces 14*b* and 15*b* which are inclined so as to expand outward in the width direction toward an upward direction are formed.

The die 14 is connected to a gas damper 66 (elastic mechanism) provided in the support portion 53 of the die 11. The gas damper 66 extends inward in the width direction from the support portion 53 and is connected to the die 14. The die 15 is connected to a gas damper 67 (elastic mechanism) provided in the support portion 54 of the die 11. The gas damper 67 extends inward in the width direction from the support portion 54 and is connected to the die 15. The gas dampers 66 and 67 are elastic mechanisms that apply elastic forces to the dies 14 and 15 to a side of the metal pipe material 40 in the width direction, that is, inward.

Here, the dies 14 and 15 are configured so as to be moved away from the metal pipe material 40 as the lower die 11 and the upper die 12 approach each other. In the present embodiment, as the upper die 12 is lowered, the dies 14 and 15 move outward in the width direction. Specifically, the dies 14 and 15 move outward in the width direction so as to be moved away from the metal pipe material 40 as the die 11 and the die 12 approach each other by tapered structures 71 and 72 formed with the upper die 12.

Next, a procedure for forming with the forming tool 2 will be described. As shown in FIG. 3A, in an initial forming state, the dies 11, 12, 14, and 15 are disposed at positions separated from the metal pipe material 40. Here, in the present embodiment, the dies 14 and 15 are disposed such that the flange portions 41*b* and 41*c* on both sides (refer to FIG. 4B) have the same size in the width direction. Specifically, the dies 14 and 15 are disposed at positions symmetrical with respect to a center position of the forming tool 2 in the width direction. Accordingly, the regulation surfaces 14*a* and 15*a* inside the dies 14 and 15 in the width direction are disposed at the same distance with respect to the center position of the forming tool 2 in the width direction. The control unit 8 heats the metal pipe material 40 in this state.

Figure 3B:
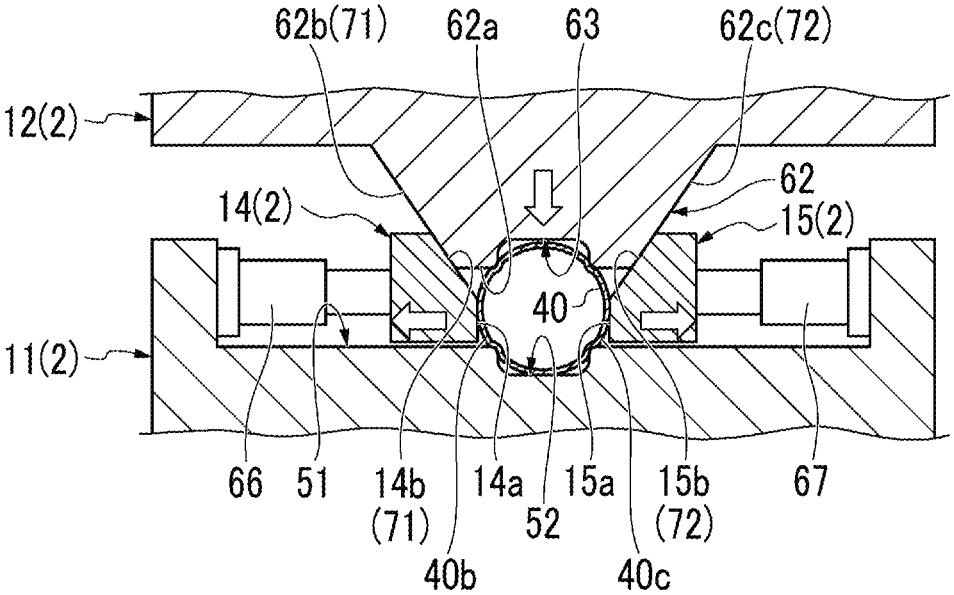

Next, as shown in FIG. 3B, the control unit 8 lowers the die 12 downward. Here, the die 12 is lowered to a position where the tapered surfaces 62*b* and 62*c* of the die 12 come into contact with the tapered surfaces 14*b* and 15*b* of the dies 14 and 15. In addition, the control unit 8 controls the fluid supply unit 6 to supply the fluid into the metal pipe material 40 to perform blow forming (primary blowing). The portions of the planned flange portions 40*b* and 40*c* on both sides of the metal pipe material 40 in the width direction expand so as to enter between the planar portion 51 of the die 11 and the lower surface 62*a* of the die 12. At this time, the planned flange portions 40*b* and 40*c* come into contact with the regulation surfaces 14*a* and 15*a* of the dies 14 and 15, so that further outward deformation in the width direction is restricted. In this way, in a state in which the dies 14 and 15 regulate the planned flange portions 40*b* and 40*c* with the regulation surfaces 14*a* and 15*a*, misalignment of the planned flange portions 40*b* and 40*c* can be corrected.

Next, as shown in FIG. 4A, the control unit 8 further lowers the die 12. At this time, the tapered surfaces 62*b* and 62*c* of the die 12 also move downward. Then, the tapered surfaces 14*b* and 15*b* of the dies 14 and 15 are guided by the tapered surfaces 62*b* and 62*c* of the die 12, and thus move outward in the width direction. Therefore, the regulation surfaces 14*a* and 15*a* of the dies 14 and 15 also move outward in the width direction. The dies 14 and 15 are maintained in a state of being pressed against the tapered surfaces 62*b* and 62*c* of the die 12 by the elastic forces of the gas dampers 66 and 67.

On the other hand, the planned flange portions 40*b* and 40*c* of the metal pipe material 40 are further crushed between the planar portion 51 of the die 11 and the lower surface 62*a* of the die 12, so that dimensions thereof in the width direction gradually increase with lowering of the die 12. However, even when the planned flange portions 40*b* and 40*c* try to largely protrude outward in the width direction due to variation, they are regulated by the regulation surfaces 14*a* and 15*a* of the dies 14 and 15 and do not become larger than that. In this way, even in a state in which the dies 14 and 15 are not in contact with the planned flange portions 40*b* and 40*c*, a state in which the planned flange portions 40*b* and 40*c* (the planned flange portions 40*b* and 40*c* trying to largely protrude) are regulated with the regulation surfaces 14*a* and 15*a* can be said to be a state in which the misalignment of the planned flange portions 40*b* and 40*c* is corrected.

Figure 4B:
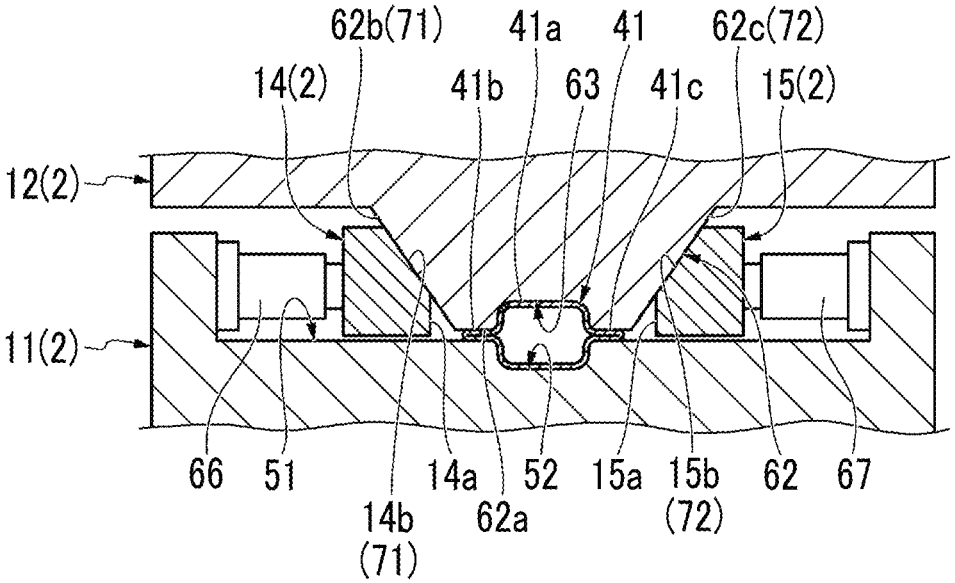

The control unit 8 further lowers the die 12 so that the dies 11 and 12 are completely closed as shown in FIG. 4B (bottom dead point). At this time, the planned flange portions 40*b* and 40*c* are completely crushed to complete flange portions 41*b* and 41*c*. In this state, the control unit 8 completes the metal pipe 41 by forming the pipe portion 41*a* corresponding to the shapes of recessed portions 52 and 63 by sharing the fluid to the metal pipe material 40 by the fluid supply unit 6. Thereafter, when the control unit 8 moves the die 12 upward to open the dies, the dies 14 and 15 return to positions shown in FIG. 3A due to restoring forces of the gas dampers 66 and 67. Here, a state in which the dies 11 and 12 are completely closed corresponds to a state in which the dies 11 and 12 are clamped. The dies 14 and 15 continue to correct the misalignment of the planned flange portions 40*b* and 40*c* until the dies are clamped.

Next, operations and effects of the forming device 1 according to the present embodiment will be described.

In the forming device 1, the forming tool 2 includes the dies 11 and 12 facing each other in the vertical direction (first direction) in a cross-sectional view. In addition, the forming tool 2 includes the dies 14 and 15 disposed on both sides of the metal pipe material 40 in the width direction (second direction) intersecting the vertical direction. The dies 14 and 15 can restrict the planned flange portions 40*b* and 40*c* of the metal pipe material 40, which are crushed by the dies 11 and 12, from expanding excessively in the width direction. Here, the dies 14 and 15 move away from the metal pipe material 40 as the die 11 and the die 12 approach each other. Therefore, even in a state in which a die closing operation of the die 11 and the die 12 progresses so that crushing of the planned flange portions 40*b* and 40*c* progresses, the dies 14 and 15 can continue to regulate the planned flange portions 40*b* and 40*c*. As described above, it is possible to reduce the variation in size of the flange portions 41*b* and 41*c* after completion.

The dies 14 and 15 move away from the metal pipe material 40 as the die 11 and the die 12 approach each other by the tapered structures 71 and 72 formed with the upper die 12. In this case, the dies 14 and 15 can be kept away from the metal pipe material 40 by a simple structure in which only the tapered structures 71 and 72 are provided.

The metal pipe 41 includes the flange portions 41*b* and 41*c* on both sides in the width direction, and the forming tool 2 includes the pair of dies 14 and 15 disposed on both sides of the metal pipe material 40 in the width direction. In this case, it is possible to reduce variation in size of the flange portions 41*b* and 41*c* on both sides of the metal pipe 41.

The forming device 1 further includes the gas dampers 66 and 67 that apply elastic forces to the dies 14 and 15 to a side of the metal pipe material 40 in the width direction. In this case, the dies 14 and 15 can be returned to their original positions when the dies 11 and 12 are opened without providing an expensive actuator or the like.

Each of the pair of dies 14 and 15 is disposed such that the flange portions 41*b* and 41*c* on both sides have the same size in the width direction. In this case, the flange portions 41*b* and 41*c* on both sides of the metal pipe 41 can have the same size.

The forming tool 2 forms the metal pipe 41 which is curved when viewed from the vertical direction. In this case, the sizes of the flange portions 41*b* and 41*c* tend to vary between an inner peripheral side and an outer peripheral side of the curve, but the variation can be reduced by adopting the configuration of the present embodiment.

The forming device 1 further includes the fluid supply unit 6 that supplies a fluid to the heated metal pipe material 40. The sizes of the flange portions 41*b* and 41*c* of the heated metal pipe material 40 tend to vary due to variation in temperature or the like, but the variation can be reduced by adopting the configuration of the present embodiment.

Figure 9B:
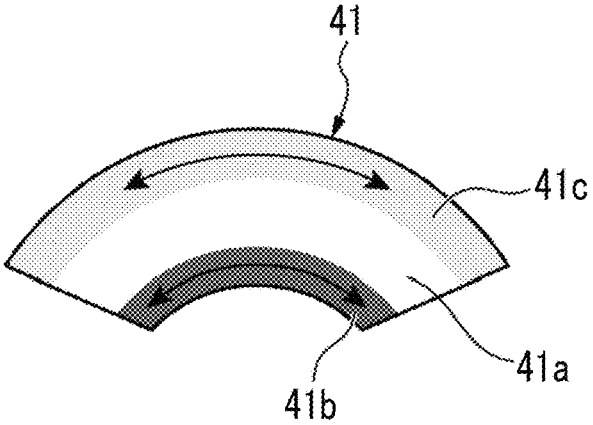
Figure 9C:
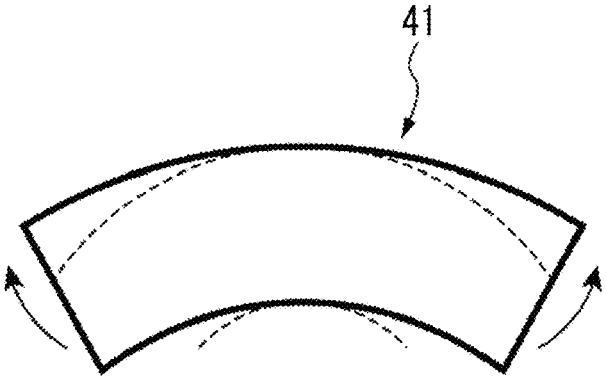

A relationship between bending and a temperature of the metal pipe 41 (metal pipe material 40) will be described in more detail. As shown in FIG. 9A, when the metal pipe material 40 is electrically heated, a current density is higher on an inner peripheral side than on an outer peripheral side, and the temperature is higher on the inner peripheral side, so that a heating temperature difference occurs. Then, an amount of thermal expansion of the metal pipe material 40 is larger on the inner peripheral side than on the outer peripheral side. Further, as shown in FIG. 9B, when the dies 11 and 12 are closed to form the flange portions 41*b* and 41*c*, a compressive force acts on the inner peripheral side and a tensile force acts on the outer peripheral side. As a result, the flange portion 41*b* on the inner peripheral side is in a state of excess material. Therefore, as shown in FIG. 9C, the metal pipe 41 is deformed to reduce a bending angle due to influences of expansion and contraction in the longitudinal direction and a difference in the amount of thermal expansion, and a center of the pipe tends to shift to the outer peripheral side. Therefore, in a case where the dies 14 and 15 as in the present embodiment are not provided, the size of the flange portion 41*b* on the inner peripheral side tends to be larger in the width direction. On the other hand, in the forming device 1 according to the present embodiment, since the variation of the flange portions 41*b* and 41*c* can be reduced by the dies 14 and 15, the size of the flange portion 41*b* on the inner peripheral side and the size of the flange portion 41*c* on the outer peripheral side can be made uniform. In addition, by appropriately adjusting operations of the dies 14 and 15, it is possible to improve a degree of freedom in forming a corner R of the metal pipe 41 having a complicated shape.

In the forming device 1, the dies 14 and 15 continue to correct the misalignment of the planned flange portions 40*b* and 40*c* until the die 11 and the die 12 are clamped. Therefore, even in a state in which a die closing operation of the dies 11 and 12 progresses so that crushing of the planned flange portions 40*b* and 40*c* progresses, the dies 14 and 15 can continue to correct the misalignment of the planned flange portions 40*b* and 40*c*. As described above, it is possible to reduce the variation in size of the flange portions 41*b* and 41*c* after completion.

The present invention is not limited to the above-described embodiment.

For example, in the above-described embodiment, the dies 14 and 15 are disposed such that the size of the flange portion 41*b* in the width direction and the size of the flange portion 41*c* in the width direction are the same. Alternatively, each of the pair of dies 14 and 15 may be disposed such that the sizes of the flange portions 41*b* and 41*c* on both sides in the width direction are predetermined sizes different from each other. In this case, each of the flange portions 41*b* and 41*c* on both sides of the metal pipe 41 can have a desired size.

Figure 5A:
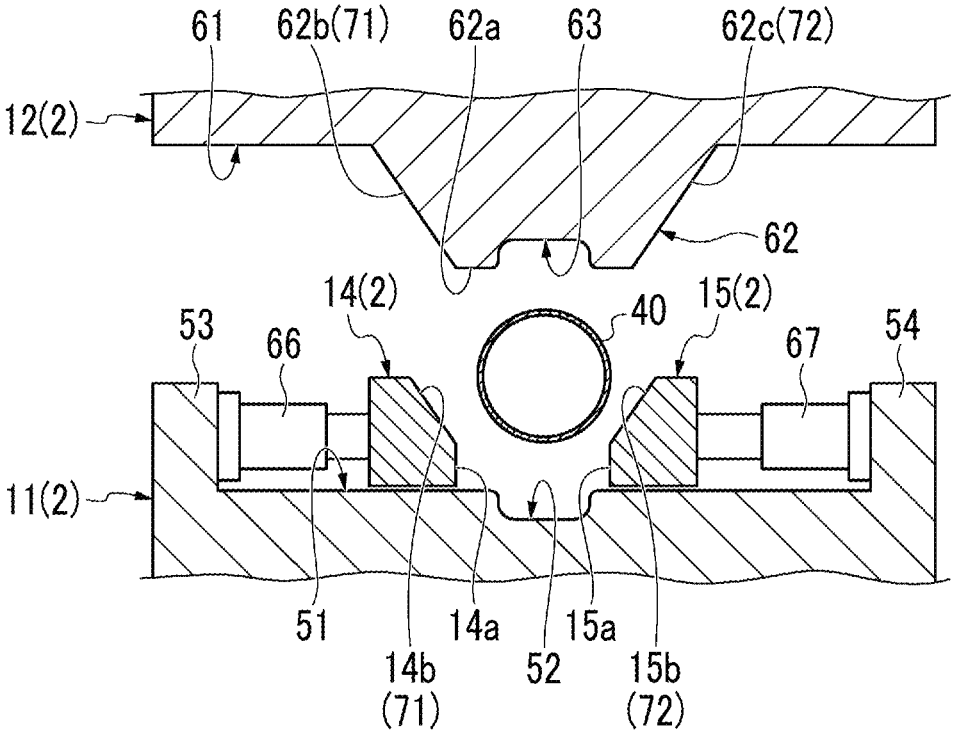
FIGS. 5A and 5B are cross-sectional views showing a forming process using the forming tool.
Figure 5B:
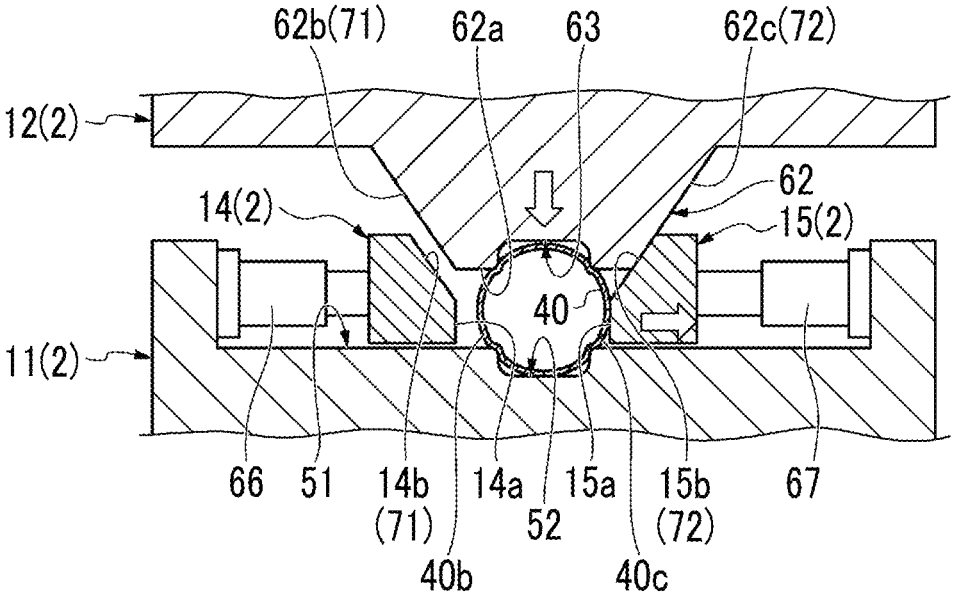
Figure 6A:
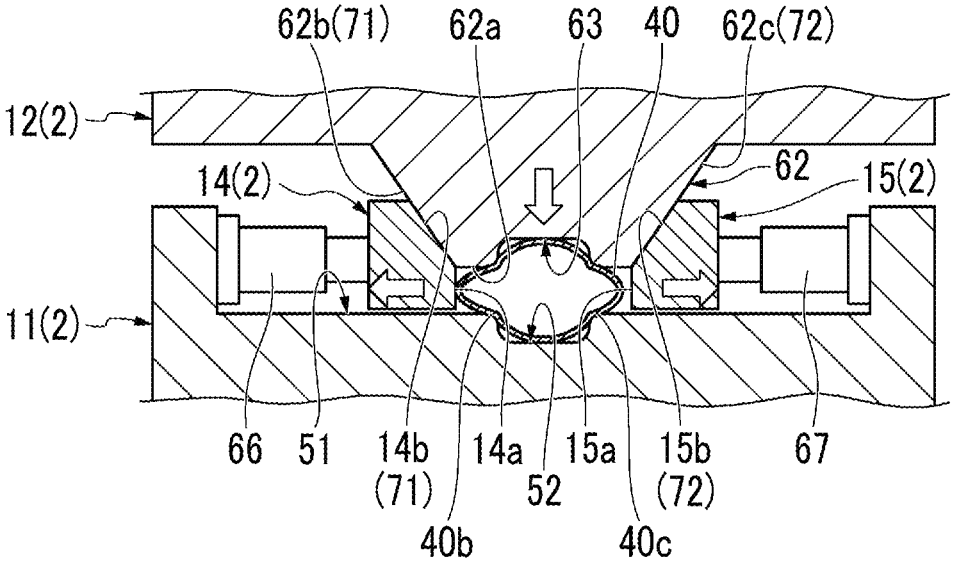
FIGS. 6A and 6B are cross-sectional views showing a forming process using the forming tool.
Figure 6B:
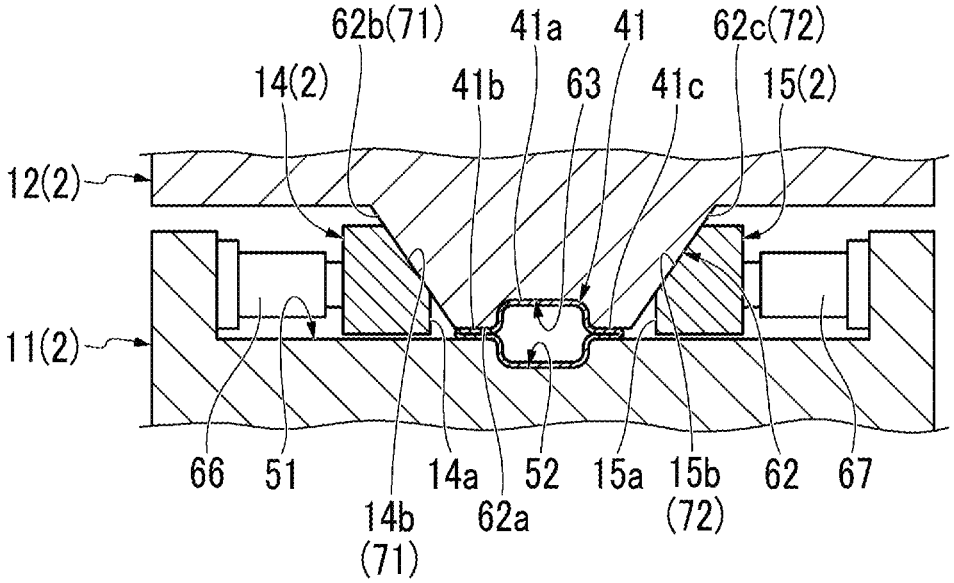

For example, as shown in FIG. 6B, the flange portion 41*b* may be formed to be larger than the flange portion 41*c*. In this case, as shown in FIG. 5A, in an initial state, the regulation surface 14*a* of the die 14 may be disposed farther from the center position of the forming tool 2 in the width direction than the regulation surface 15*a* of the die 15 is. In this case, as shown in FIG. 5B, at a stage of performing primary blowing, the planned flange portion 40*c* comes into contact with the regulation surface 15*a*, while the planned flange portion 40*b* is in a state of being separated from the regulation surface 14*a*. Therefore, the planned flange portion 40*c* can expand while being regulated by the regulation surface 15*a*, while the planned flange portion 40*b* can expand without being regulated. As shown in FIG. 6A, when the control unit 8 further moves the die 12 downward, the die 15 moves outward, while the die 14 does not move until the die 14 comes into contact with the tapered surface 62*b*. On the other hand, the planned flange portion 40*b* is crushed and expands outward to come into contact with the regulation surface 14*a*. Accordingly, the planned flange portion 40*b* is regulated by the regulation surface 14*a*. The control unit 8 further moves the die 12 downward, so that the flange portions 41*b* and 41*c* are completed as shown in FIG. 6B.

As described above, the metal pipe 41 shown in FIG. 6B includes the hollow pipe portion 41*a* and the pair of flange portions 41*b* and 41*c* protruding from the pipe portion 41*a* to both sides in the width direction, and the sizes of the pair of flange portions 41*b* and 41*c* in the width direction are predetermined sizes different from each other.

In the metal pipe 41, the sizes of the pair of flange portions 41*b* and 41*c* in the width direction are predetermined sizes different from each other. In this case, since processing is performed such that each of the flange portions 41*b* and 41*c* has a predetermined size during forming, it is possible to reduce the variation in size of the flange portions 41*b* and 41*c*.

Also in the embodiment shown in FIGS. 5A and 5B and FIGS. 6A and 6B, the dies 14 and 15 continue to correct the misalignment of the planned flange portions 40*b* and 40*c* until the die 11 and the die 12 are clamped (FIG. 6B).

In the above-described embodiment, the metal pipe 41 includes the pair of flange portions 41*b* and 41*c*. Alternatively, the metal pipe 41 may have a flange portion on only one side in the width direction. For example, as shown in FIG. 8B, the metal pipe 41 may have only the flange portion

Figure 7A:
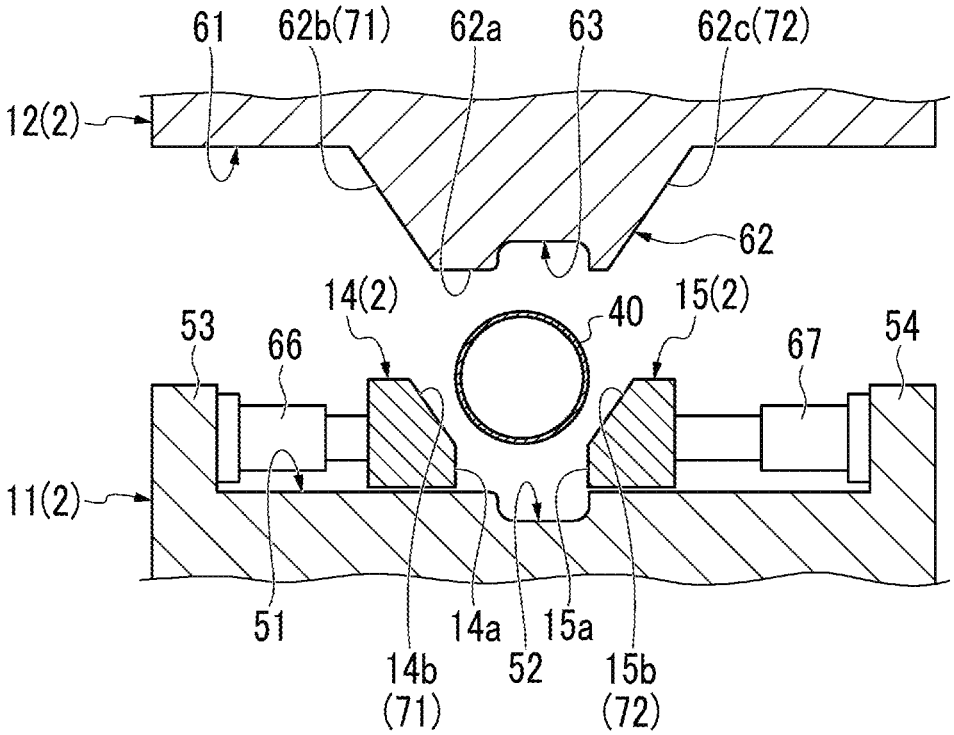
FIGS. 7A and 7B are cross-sectional views showing a forming process using the forming tool.
Figure 7B:
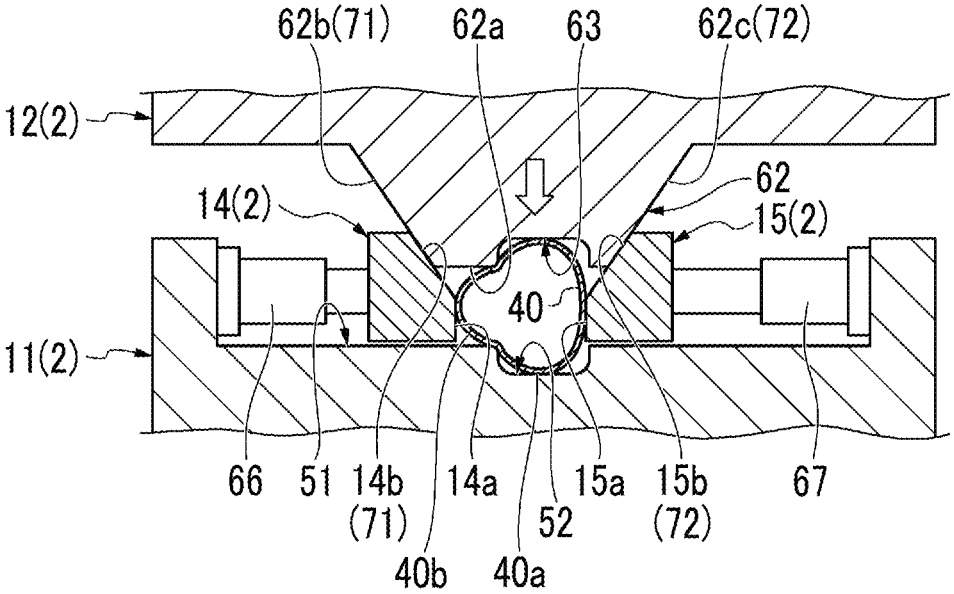
Figure 8A:
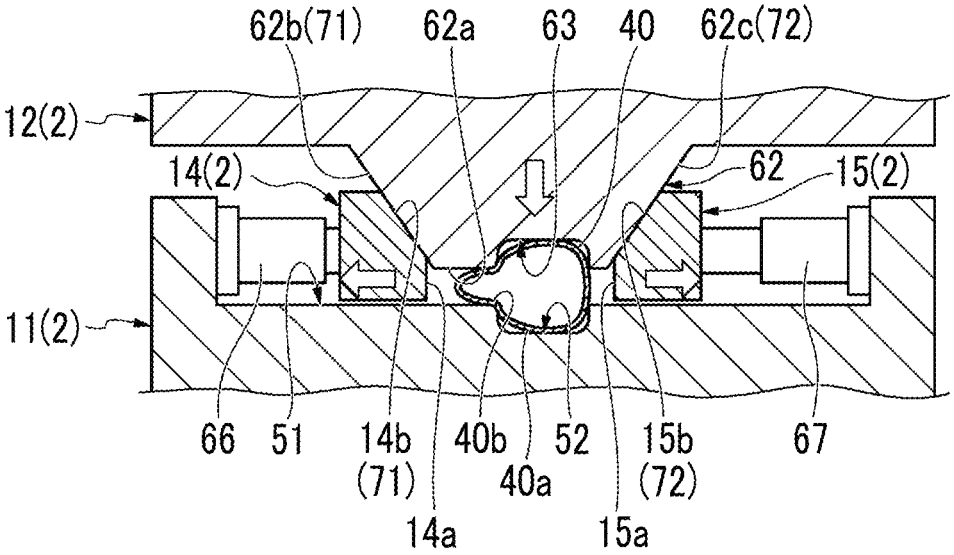
FIGS. 8A and 8B are cross-sectional views showing a forming process using the forming tool.

41*b* on one side. In this case, as shown in FIG. 7A, in the initial state, the regulation surface 14*a* of the die 14 may be disposed farther from the center position of the forming tool 2 in the width direction than the regulation surface 15*a* of the die 15 is. Further, the recessed portions 52 and 63 are formed so as to be shifted to the right side of the center position. In this case, the regulation surface 15*a* is disposed at a position of right end portions of the recessed portions 52 and 63. In this case, as shown in FIG. 7B, at a stage of performing primary blowing, the planned flange portion 40*b* comes into contact with the regulation surface 14*a*, while a right end portion of a pipe portion 40*a* comes into contact with the regulation surface 15*a*. Therefore, the planned flange portion is not formed on the right side. As shown in FIG. 8A, when the control unit 8 further moves the die 12 downward, the dies 14 and 15 move outward. A state in which the planned flange portion is not formed on the right side of the pipe portion 40*a* is continued. The control unit 8 further moves the die 12 downward, so that the flange portion 41*b* is completed as shown in FIG. 8B.

Figure 8B:
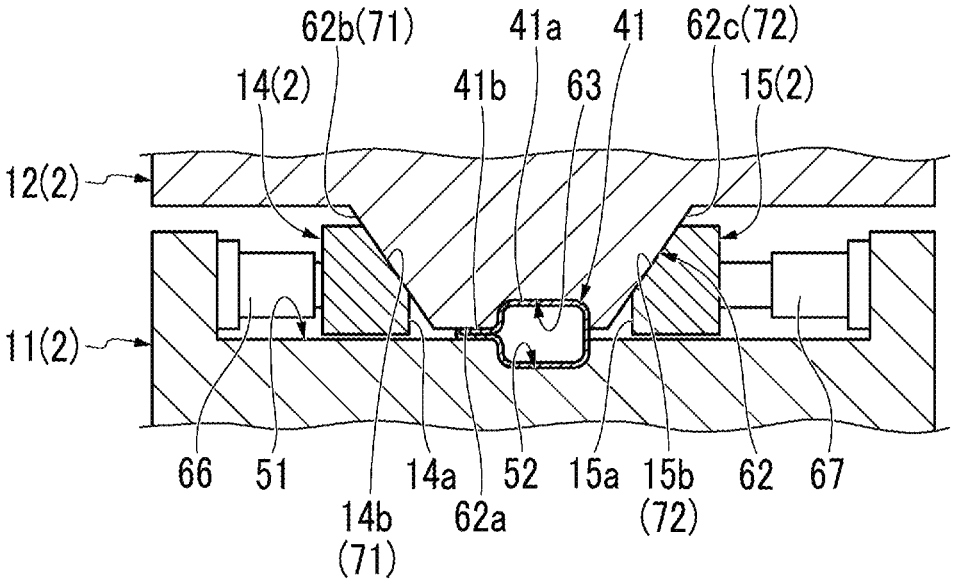

Also in the embodiment shown in FIGS. 7A and 7B and FIGS. 8A and 8B, the die 14 continues to correct the misalignment of the planned flange portion 40*b* until the die 11 and the die 12 are clamped (FIG. 8B).

In the above-described embodiment, the dies for regulation are provided on both sides in the width direction, but may be provided only on one side in the width direction.

In the above-described embodiment, the tapered structures 71 and 72 are formed between the dies 14 and 15 and the upper die 12. Alternatively, the tapered structures may be formed between the dies 14 and 15 and the lower die 11 or may be formed between the dies 14 and 15 and both the dies 11 and 12.

In the above-described embodiment, the gas damper is adopted as the elastic mechanism, but the elastic mechanism may be anything that generates an elastic force and may be formed of an elastic member or the like. In addition, the dies 14 and 15 may have a configuration in which positions thereof in the width direction can be controlled by an actuator or the like.

In the above-described embodiment, the description has been made by using the forming tool adopted in the forming device for STAF as an example. However, the type of the forming device in which the forming tool according to the present invention is adopted is not particularly limited, and may be any type of the forming device that supplies a fluid to expand the metal pipe material.

It should be understood that the invention is not limited to the above-described embodiment, but maybe modified into various forms on the basis of the spirit of the invention. Additionally, the modifications are included in the scope of the invention.

What is claimed is:

1. A forming device that forms a metal pipe with a flange, comprising:

a forming tool for forming the metal pipe, wherein the forming tool includes a first die and a second die that face each other in a first direction in a cross-sectional view, and a third die for regulating a planned flange portion of a metal pipe material, the third die is configured to continuously correct misalignment of the planned flange portion until the first die and the second die are clamped, and the forming tool forms the metal pipe which is curved when viewed from the first direction.

2. The forming device according to claim 1, wherein the first die includes a planar portion expanding in a width direction, a recessed portion formed at a center position in the width direction of the planar portion, and support portions formed at both outer end portions in the width direction.

3. The forming device according to claim 1, wherein the second die includes a planar portion expanding in a width direction, and a forming body portion protruding downward at a center position of the planar portion in the width direction.

4. The forming device according to claim 3, wherein the forming body portion has a substantially cross-sectional shape that narrows downward.

5. The forming device according to claim 4, wherein the forming body portion includes a recessed portion on a lower surface.

6. The forming device according to claim 1, wherein the third die is disposed on at least one side of the metal pipe material in a second direction intersecting the first direction, and the third die moves away from the metal pipe material as the first die and the second die approach each other.

7. The forming device according to claim 1, wherein the third die moves away from the metal pipe material as the first die and the second die approach each other by a tapered structure formed with at least one of the first die and the second die.

8. The forming device according to claim 1, further comprising a fluid supply unit that supplies a fluid to the metal pipe material that is heated.

9. The forming device according to claim 8, wherein the fluid supply unit includes a nozzle that supplies a fluid from an opening portion of an end portion of the metal pipe material to an inside of the metal pipe material, a drive mechanism that moves the nozzle forward and backward with respect to the opening portion of the metal pipe material, and a supply source that supplies the fluid into the metal pipe material via the nozzle.

10. The forming device according to claim 8, wherein the fluid supply unit is provided on both end sides of the forming tool in a longitudinal direction.

11. The forming device according to claim 1, further comprising an elastic mechanism that applies an elastic force to the third die toward the metal pipe material in a second direction intersecting the first direction.

* * * * *